US005844526A

United States Patent [19]

Jones

[11] Patent Number: 5,844,526

[45] Date of Patent: Dec. 1, 1998

[54] THERMALLY INSULATED SATELLITE REFLECTOR ASSEMBLY

[75] Inventor: Thaddeus M. Jones, Bremen, Ind.

[73] Assignee: MSX, Inc., South Bend, Ind.

[21] Appl. No.: 831,890

[22] Filed: Apr. 3, 1997

[51] Int. Cl.[6] ..... H01Q 1/02; H01Q 1/12

[52] U.S. Cl. ..... 343/704; 343/912; 250/33.65; 239/548

[58] Field of Search ..... 343/704, 912; 239/548; H01Q 1/02, 1/12

[56] References Cited

U.S. PATENT DOCUMENTS 5,617,107 4/1997 Fleming ..... 343/704

FOREIGN PATENT DOCUMENTS 401254003A 10/1989 Japan ..... H01Q 1/12

402174401A 7/1990 Japan ..... H01Q 1/02

405112915A 5/1993 Japan ..... E01F 9/00

*Primary Examiner*—Frank G. Font
*Assistant Examiner*—Layla G. Lauchman
*Attorney, Agent, or Firm*—Taylor & Associates, P.C.

[57] ABSTRACT

The invention is directed to a reflector assembly in a satellite system including a reflector having a reflecting surface and a back surface. The back surface is opposite the reflecting surface and has a plurality of ribs extending transversely therefrom. The reflector further includes a heater assembly embedded therein. The reflector assembly further includes a layer of closed cell plastic foam insulation which covers the heater assembly within the reflector. An inside surface of the insulation is disposed adjacent to the back surface of the reflector and includes a plurality of grooves. The plurality of grooves are configured to receive the plurality of ribs therein. The layer of insulation also includes a coating of ultraviolet radiation protectant disposed over an outside surface of the insulation.

20 Claims, 3 Drawing Sheets

THERMALLY INSULATED SATELLITE REFLECTOR ASSEMBLY

BACKGROUND OF THE INVENTION

1. Field of the Invention

The present invention relates to satellite systems, and, more particularly, reflectors for satellite systems.

2. Description of the Related Art.

A reflector, commonly called a dish, is generally a parabolic section having a round, elliptical or other configuration. A reflector functions to gather radio or microwave frequency energy transmitted from the feedhorn or through the ambient environment from an external transmitter. The reflector can thus be used to receive and transmit signals to and from the satellite system. Reflectors are usually located outdoors, where snow and ice may collect on the receiving or concave side, degrading the performance of the reflector.

It is known to heat the front receiving surface of the reflector with an embedded heater wire. A problem with embedding a heater wire within a reflector in a conventional manner is that heat is conducted through the reflector to the back surface thereof. The heat is then radiated to the ambient environment, resulting in a reduced thermal efficiency of the embedded heater wire.

What is needed in the art is a reflector assembly for a satellite system including a heater assembly which inhibits or melts snow or ice accumulation on the reflecting surface of the reflector using embedded heater wire, and improves the thermal efficiency of the reflector assembly by reducing the amount of heat loss through the back surface of the reflector.

SUMMARY OF THE INVENTION

The present invention provides a reflector assembly in a satellite system having a molded, closed cell plastic foam layer of insulation which is adhered to and closely conforms with an irregular back surface of the reflector, and improves the thermal efficiency of the reflector assembly by reducing heat loss from the back surface of the reflector.

The invention comprises, in one form thereof, a reflector assembly in a satellite system including a reflector having a reflecting surface and a back surface. The back surface is opposite the reflecting surface and has a plurality of ribs extending transversely therefrom. The reflector further includes a heater assembly embedded therein. The reflector assembly further includes a layer of closed cell plastic foam insulation which covers the heater assembly within the reflector. An inside surface of the insulation is disposed adjacent to the back surface of the reflector and includes a plurality of grooves. The plurality of grooves are configured to receive the plurality of ribs therein. The layer of insulation also includes a coating of ultraviolet radiation protectant disposed over an outside surface of the insulation.

An advantage of the present invention is that the layer of closed cell plastic foam insulation may be molded to conform to the back surface of any particular reflector, and thereby provide easy installation of the insulation on the corresponding reflector.

Another advantage is that the ribs on the back side of the reflector are covered by the molded layer of insulation, which saves energy costs both in terms of an improved thermal efficiency by reducing heat loss through the ribs, and reducing the need for axillary control equipment associated with higher power heating systems when the ribs are not insulated.

Yet another advantage of the present invention is that any water that enters the assembly drains out. Thus, the contraction and expansion cycles of the water will not work the insulation loose from the reflector.

Still another advantage is that the assembly may be exposed to prolonged periods of ultraviolet light without sustaining significant damage.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
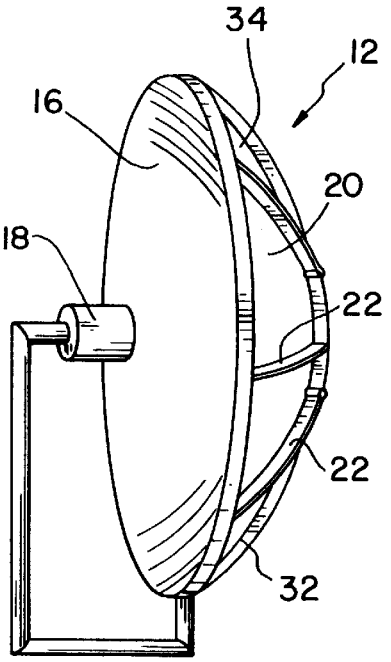
FIG. 1 is a perspective view of a reflector of the present invention attached to a feedhorn.

Referring now to the drawings, there is shown a reflector assembly 10 including a reflector 12 and a layer of insulation 14.

Reflector 12 includes a reflecting surface 16 having a desired curvature for the specific application for which reflector assembly 10 is to be utilized. For example, reflecting surface 16 may have a concave parabolic curvature with a circular or elliptical shaped perimeter. Reflecting surface 16 reflects radio or microwave frequency energy transmitted from a feedhorn 18 or an external source (not shown).

Figure 3:
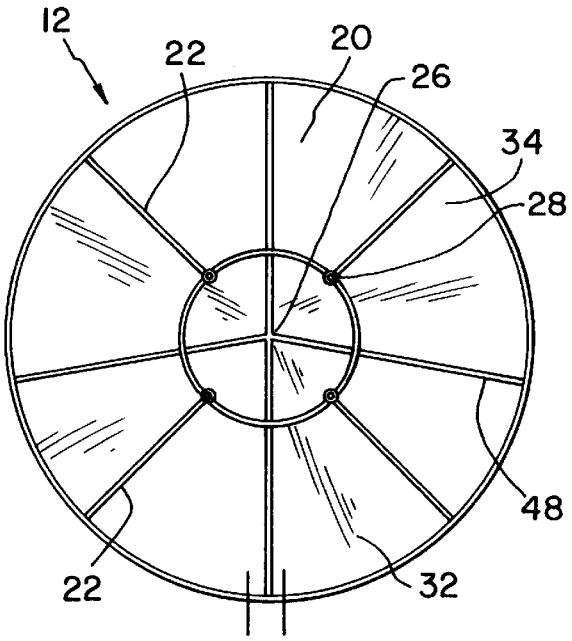
FIG. 3 is a back view of the reflector of FIG. 1.

Reflector 12 also includes a back surface 20 having a plurality of ribs 22 extending transversely therefrom. Ribs 22 each have a height 24 of approximately two inches in the embodiment shown and provide structural support to reflector 12. Ribs 22 are shown as predominantly extending radially outward from center 26 on back surface 20. However, it is to be understood that ribs 22 can be arranged in many different configurations. Back surface 20 also has a plurality of bolt holes 28 (FIGS. 3 and 4) for bolting a plate (not shown) near center 26 of back surface 20.

Figure 2:
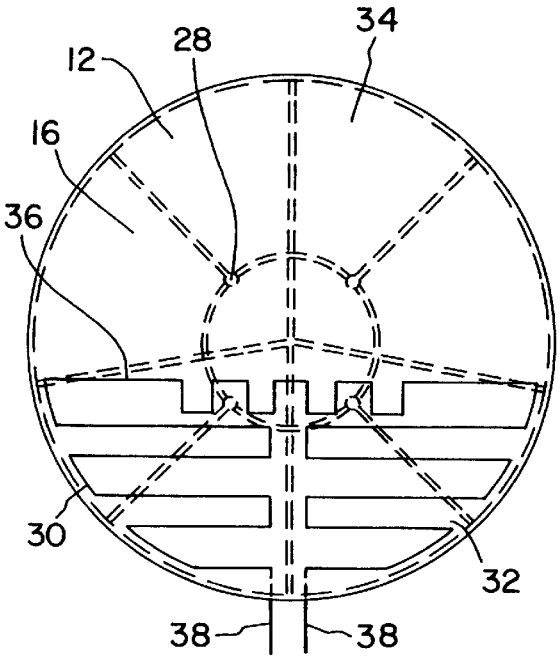
FIG. 2 is a front view of the reflector of FIG. 1 with a heater wire embedded therein.

Reflector 12 further includes an embedded heater wire 30 (FIG. 2). Heater wire 30 is embedded within reflector 12 closer w to reflecting surface 16 than to back surface 20. Heater wire 30, in the embodiment shown in FIG. 2, is entirely disposed within bottom half 32 of reflector 12 in a zig-zag manner with successive rows connected by short segments on the ends of the rows. However, it is to be understood that heater wire 30 can be disposed in any of a number of patterns on both top half 34 and bottom half 32 of back surface 20. Heater wire 30, in the embodiment shown in FIG. 2, is also disposed in a zig-zag manner within top row 36 of the larger zig-zag pattern. This is to concentrate more of heater wire 30, and hence more heat, around bolt holes 28. More heating is needed around bolt holes 28 in order to compensate for the additional conduction heat losses through the bolts and mounting plate (not shown) associated therewith. Heater wire 30 has two ends 38 extending out of back surface 20. Ends 38 are connected to a current source (not shown) which sources current through heater wire 30, causing the temperature of wire 30 to rise.

Figure 5:
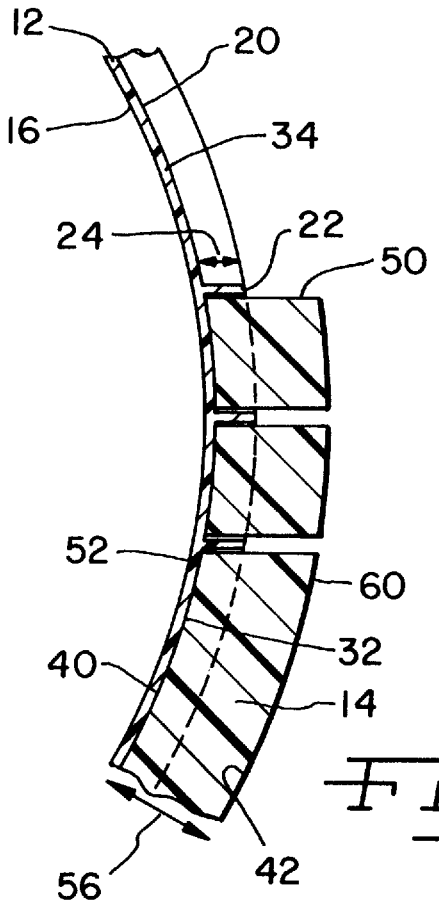
FIG. 5 is a fragmentary, sectional view of the reflector assembly shown in FIG. 4 taken along line 5—5.
Figure 6:
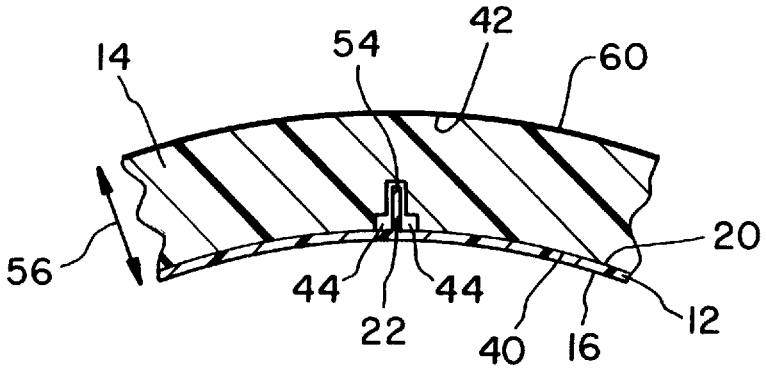
FIG. 6 is a fragmentary, sectional view of the reflector assembly shown in FIG. 4 taken along line 6—6.

Layer of insulation 14 is fabricated from a layer of air-entrapped foam insulation such as closed cell plastic foam, preferably polystyrene. Insulation 14 includes an inside surface 40 and an outside surface 42 (FIG. 5). Inside surface 40 of insulation 14 is attached and disposed adjacent to back surface 20 of reflector 12. Inside surface 40 is shown as touching back surface 20 in FIGS. 5 and 6. However, it is to be understood that there can be a small gap, e.g., 1/16 inch, between inside surface 40 and back surface 20. Inside surface 40, back surface 20 and ribs 22 define a plurality of weep channels 44 (FIG. 6) which allow water to drain out along a rib 22. Water may enter between inside surface 40 and back surface 20 as a result of rain, condensation or melting snow and ice. In another embodiment (not shown), weep channels 44 are defined by a plurality of vertical channels in inside surface 40 of insulation 14.

Insulation 14 covers heater wire 30 within reflector 12, thereby inhibiting heat loss through back surface 20 of reflector 12. Insulation 14, in the embodiment shown in FIG. 4, substantially covers only bottom half 32 of back surface 20, corresponding to the placement of heater wire 30 within reflector 12 shown in FIG. 2. Additionally, insulation 14 extends approximately one inch above horizontal rib 48. Horizontal rib 48 separates top half 34 and bottom half 32 of back surface 20. A horizontal rib 48 is covered by insulation 14 to prevent an unacceptable amount of heat loss from horizontal rib 48. Top edge 50 of insulation 14 is adhered and sealed to back surface 20 with an appropriate sealant, defining a waterproof seal 52. Waterproof seal 52 prevents water and debris from falling between inside surface 40 of insulation 14 and back surface 20 of reflector 12. Waterproof seal 52 also prevents heat loss from convection currents rising out from between insulation 14 and reflector 12.

Inside surface 40 of insulation 14 includes a plurality of grooves 54 (FIG. 6), each of which is configured to receive a corresponding one of ribs 22. Grooves 54 are contoured around each of ribs 22 to retain as much heat as possible within ribs 22. Insulation 14 has a thickness 56 of between approximately four and five inches, so insulation 14 extends between approximately two and three inches past ribs 22 in a direction transverse to back surface 20.

Insulation 14 also includes two through holes 58. Each of heater wire ends 38 extend through a corresponding one of through holes 58 so that ends 38 can be connected to an external current source (not shown).

Figure 4:
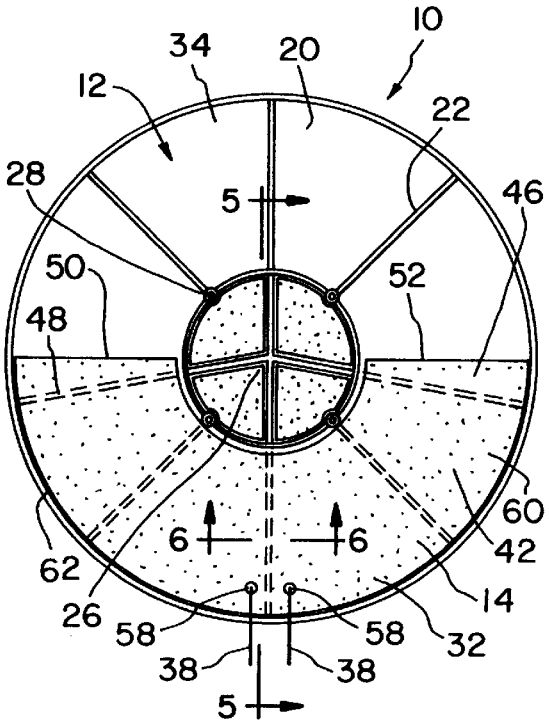
FIG. 4 is a back view of the reflector shown in FIGS. 1–3 with an embodiment of a layer of molded closed cell plastic foam insulation attached thereto.

Insulation 14 further includes a coating of ultraviolet radiation protectant 60 disposed over outside surface 42 of insulation 14. Protectant 60 prevents degradation of insulation 14 when insulation 14 is exposed to prolonged periods of ultraviolet radiation, as usually occurs outdoors upon exposure to the sun. Protectant 60 can also be disposed over top edge 50 and a peripheral edge 62 of insulation 14 (FIG. 4). Protectant 60 can be formed with an ultraviolet resistant gel coat applied to outside surface 42.

During use, a current source (not shown) sources current through heater wire 30, heating heater wire 30. This heat transfers through reflector 12 to reflecting surface 16, melting any accumulated ice and snow. The heat also hastens the evaporation of any water on reflecting surface 16. Insulation 14 improves the heat transfer efficiency of reflector assembly 10 by inhibiting heat transfer from back surface 20 of reflector 12. Waterproof seal 52 prevents any precipitation from entering between inside surface 40 of insulation 14 and back surface 20 of reflector 12. Should any water find its way into the area between reflector 12 and insulation 14, perhaps by condensation, it will flow out through weep channels 44.

Figure 7:
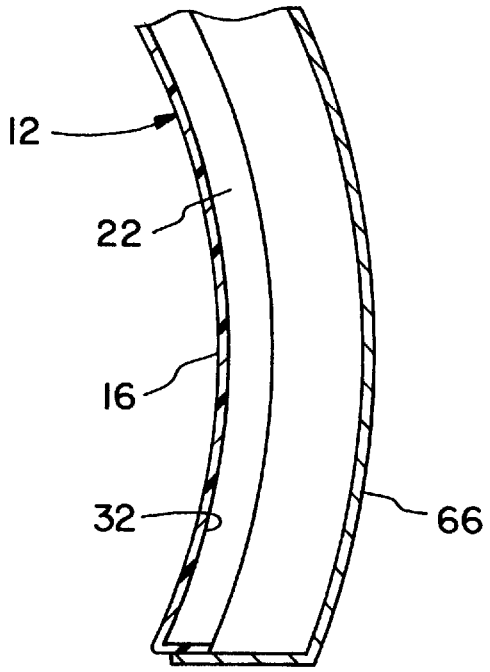
FIG. 7 is a fragmentary, side sectional view showing how the back of a reflector and a complimentary mold half may be used for making the molded insulation of the present invention.

During manufacture, insulation 14 is molded to include grooves 54 within inside surface 40 of insulation 14. Inside surface 40 is molded with a shape and size which substantially conforms to back surface 20 of reflector 12. Grooves 54, which may be formed to define weep channels 44, are molded to closely contour ribs 22 of reflector 12. Insulation 14 may be molded using conventional molds and molding techniques. However, it is also possible to use at least a portion of a reflector which is coupled with a mating mold half such that the closed cell plastic foam insulation may be injected therebetween. For example, referring to FIG. 7, at least a portion of a reflector 12 may be used as one-half of a mold into which the polystyrene insulation is injected. A mating mold half 66 is coupled with reflector 12 and defines a substantially sealed cavity with reflector 12 (the upper portion of the sealed cavity defined by reflector 12 and mold half 66 not shown in the fragmentary view of FIG. 7 for purposes of simplicity). A sprue hole or other suitable access port (not shown) is provided within mold half 66 such that the closed cell plastic foam insulation may be injected into the space between mold half 66 and back surface 32 of reflector 12. The injected plastic foam substantially surrounds ribs 22 and fills the space between mold half 66 and back surface 32. Of course, back surface 32 of reflector 12 may need to be polished and the edges of various projections such as ribs 22 rounded off to effect release between the injected plastic foam and reflector 12 upon curing of the plastic foam. Release agents may likewise be applied to back surface 32 and/or the inside surface of mold half 66 to assist in release of the molded plastic foam upon curing thereof.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reflector assembly in a satellite system, comprising:

a reflector including a reflecting surface and a back surface, said back surface opposite said reflecting surface, said back surface having a plurality of ribs extending transversely therefrom, said reflector further including a heater assembly embedded therein between said front surface and said back surface; and a layer of air-entrapped foam insulation covering said heater assembly within said reflector, said layer of insulation including an inside surface and an outside surface, said inside surface disposed adjacent to said back surface of said reflector w and including a plurality of grooves, said plurality of grooves configured to receive said plurality of ribs therein, said layer of insulation further including a coating of ultraviolet radiation protectant disposed over said outside surface of said layer of insulation.

2. The reflector assembly of claim 1, wherein said back surface and said layer of insulation define a plurality of weep channels, said weep channels allowing water to drain out of the reflector assembly.

3. The reflector assembly of claim 1, wherein said reflector includes a top half and a bottom half, said heater assembly embedded only in said bottom half, said layer of insulation substantially covering only said bottom half.

4. The reflector assembly of claim 3, wherein said plurality of ribs include a substantially horizontal rib which separates said top half and said bottom half.

5. The reflector assembly of claim 4, wherein said layer of insulation extends approximately one inch above said horizontal rib.

6. The reflector assembly of claim 1, wherein said layer of insulation includes a top edge, and further comprising a sealant disposed between said top edge and said back surface, said sealant, said top edge and said back surface defining a substantially waterproof seal.

7. The reflector assembly of claim 1, wherein said layer w of insulation includes a top edge and a peripheral edge, said coating of ultraviolet radiation protectant further disposed over said top edge and said peripheral edge.

8. The reflector assembly of claim 1, wherein said heater assembly includes a heater wire having two ends, said two ends extending through said layer of insulation.

9. The reflector assembly of claim 8, further comprising two through holes in said layer of insulation, each of said two ends extending through a corresponding one of said two through holes.

10. The reflector assembly of claim 8, wherein said reflector includes a plurality of bolt holes in said back surface.

11. The reflector assembly of claim 10, wherein said heater wire is concentrated around said plurality of bolt holes.

12. The reflector assembly of claim 1, wherein said plurality of ribs have a height, said layer of insulation having a thickness between approximately two and three inches greater than said height.

13. The reflector assembly of claim 12, wherein said height of said ribs is approximately two inches.

14. The reflector assembly of claim 1, wherein each of said plurality of grooves is configured to receive a corresponding one of said plurality of ribs.

15. The reflector assembly of claim 1, wherein said coating of ultraviolet radiation protectant comprises an ultraviolet resistant gel coat.

16. The reflector assembly of claim 1, wherein said air-entrapped foam insulation is comprised of a closed cell plastic foam insulation.

17. The reflector assembly of claim 1, manufactured by a process comprising the step of molding said layer of insulation to include said plurality of grooves in said inside surface.

18. The reflector assembly of claim 17, manufactured by the process comprising the further steps of:

providing said layer of insulation with two through holes;

coating said outside surface of said insulation with said coating of ultraviolet radiation protectant;

threading each of two heater wires ends of said heater assembly through a corresponding one of said two through holes; and adhering said layer of insulation to said back surface of said reflector.

19. The reflector assembly of claim 17, wherein said molding step comprises using said reflector as a part of a mold.

20. A reflector assembly in a satellite system, comprising:

a reflector including a reflecting surface and a back surface, said back surface opposite said reflecting surface, said back surface having a plurality of ribs extending transversely therefrom, said reflector further including a heater assembly embedded therein between said front surface and said back surface; and a layer of air-entrapped foam insulation covering said heater assembly within said reflector, said layer of insulation including an inside surface and an outside surface, said inside surface disposed adjacent to said back surface of said reflector and including a plurality of grooves, said plurality of grooves configured to receive a corresponding one of said plurality of ribs therein.

* * * * *

UNITED STATES PATENT AND TRADEMARK OFFICE

CERTIFICATE OF CORRECTION

PATENT NO. : 5,844,526

DATED : Dec. 1, 1998

INVENTOR(S) : Thaddeus M. Jones

It is certified that error appears in the above-identified patent and that said Letters Patent is hereby corrected as shown below:

Column 2

Line 66, delete "w".

Column 5

Line 3, delete "w";
Line 28, delete "w".

Signed and Sealed this

Twenty-fifth Day of May, 1999

*Attest:*

Q. TODD DICKINSON

*Attesting Officer*

*Acting Commissioner of Patents and Trademarks*